US011190896B1

(12) United States Patent
Satongar et al.

(10) Patent No.: US 11,190,896 B1
(45) Date of Patent: Nov. 30, 2021

(54) SYSTEM AND METHOD OF DETERMINING HEAD-RELATED TRANSFER FUNCTION PARAMETER BASED ON IN-SITU BINAURAL RECORDINGS

(71) Applicant: Apple Inc., Cupertino, CA (US)

(72) Inventors: Darius A. Satongar, Santa Clara, CA (US); Martin E. Johnson, Los Gatos, CA (US); Peter Victor Jupin, Copenhagen (DK); Jonathan D. Sheaffer, Santa Clara, CA (US)

(73) Assignee: APPLE INC., Cupertino, CA (US)

( * ) Notice: Subject to any disclaimer, the term of this patent is extended or adjusted under 35 U.S.C. 154(b) by 122 days.

(21) Appl. No.: 16/560,418

(22) Filed: Sep. 4, 2019

Related U.S. Application Data

(60) Provisional application No. 62/737,668, filed on Sep. 27, 2018.

(51) Int. Cl.

| | |
|---|---|
| ***H04S 7/00*** | (2006.01) |
| ***H04R 1/40*** | (2006.01) |
| ***H04R 3/00*** | (2006.01) |
| ***H04R 5/027*** | (2006.01) |
| ***H04R 5/04*** | (2006.01) |
| ***H04R 5/033*** | (2006.01) |

(52) U.S. Cl.
CPC ..... *H04S 7/304* (2013.01); *H04R 1/406* (2013.01); *H04R 3/005* (2013.01); *H04R 5/027* (2013.01); *H04R 5/033* (2013.01); *H04R 5/04* (2013.01); *H04S 2400/15* (2013.01); *H04S 2420/01* (2013.01)

(58) Field of Classification Search
CPC .. H04S 7/304; H04S 2420/01; H04S 2400/15; H04S 2420/00; H04R 1/406; H04R 3/005; H04R 5/04
USPC ..... 381/303, 310
See application file for complete search history.

(56) References Cited

U.S. PATENT DOCUMENTS

| | | | | |
|---|---|---|---|---|
| 8,270,632 | B2 | 9/2012 | Hwang et al. | |
| 9,584,946 | B1 * | 2/2017 | Lyren | H04M 1/0202 |
| 9,900,555 | B1 | 2/2018 | Barreto et al. | |
| 9,955,279 | B2 | 4/2018 | Riggs et al. | |
| 2010/0241256 | A1 * | 9/2010 | Goldstein | H04R 5/04 700/94 |
| 2016/0269849 | A1 | 9/2016 | Riggs et al. | |

* cited by examiner

*Primary Examiner* — Vivian C Chin
*Assistant Examiner* — Ubachukwu A Odunukwe
(74) *Attorney, Agent, or Firm* — Womble Bond Dickinson (US) LLP

(57) ABSTRACT

An audio system and a method of using the audio system to determine an interaural head-related transfer function (HRTF) parameter, are described. The audio system can generate binaural recordings using microphones that are worn by a user in everyday scenarios. The audio system can measure interaural parameter values of selected segments of the recordings, and the measurements can be accumulated over time. The interaural HRTF parameter can be estimated based on the measurements. The interaural HRTF parameter can be used to adapt a generic HRTF to generate an individualized HRTF for the user. Other aspects are also described and claimed.

20 Claims, 8 Drawing Sheets

SYSTEM AND METHOD OF DETERMINING HEAD-RELATED TRANSFER FUNCTION PARAMETER BASED ON IN-SITU BINAURAL RECORDINGS

This application claims the benefit of priority of U.S. Provisional Patent Application No. 62/737,668, filed on Sep. 27, 2018, and incorporates herein by reference that provisional patent application.

BACKGROUND

Field

Aspects related to audio systems, are disclosed. More particularly, aspects related to audio systems used to render binaural simulations, are disclosed.

Background Information

A sound emitted by a discrete sound source travels to a listener along a direct path, e.g., through air to the listeners ear-canal entrance, and along one or more indirect paths, e.g., by reflecting and diffracting around the listeners head or shoulders. As the sound travels along the indirect paths, artifacts can be introduced into the acoustic signal that the listeners ears receive. These artifacts are anatomy dependent, and accordingly, are user-specific. Furthermore, the user-specific artifacts provide the listener with cues to localize the source of the sound. The user-specific artifacts are features of sound transmission that can be encapsulated in a dataset of head-related transfer functions (HRTF). A single HRTF of the dataset is a pair of acoustic filters (one for each ear) that characterize the acoustic transmission from a particular location in a reflection-free environment to microphones placed in the ears of a listener. A dataset of HRTFs contains the fundamental cues sued by a listener to localize sounds.

A listener can use simple stereo headphones to create the illusion of a sound source somewhere in a listening environment by applying an HRTF to a binaural simulation of the sound source. The HRTF can relate to the particular location or direction of the sound source. That is, when a relative position between the user and the location of the sound source is known, an HRTF for the relative position can be selected from the dataset of HRTFs and applied to the binaural simulation of the sound source to better simulate the sound source. Accordingly, HRTFs are selected based on the direction of the sound source relative to the listener.

Since HRTFs are highly individualized, binaural simulation using non-individualized HRTFs (for example when a listener auditions a simulation using the HRTF dataset of another person) can cause audible problems in both the perceived position and quality (timbre) of the virtual sound. As such, an HRTF that effectively simulates a sound source at a location relative to a first user may not effectively simulate the sound source at the same relative location to a second user. That is, the first user may experience the simulation as a realistic rendering, but the second user may not.

SUMMARY

Existing methods of generating individualized head-related transfer functions (HRTFs) are time-consuming or impractical to incorporate into consumer electronic devices that render binaural simulations. When HRTF individualization is impractical or impossible, a generic HRTF may be used instead. The generic HRTF can represent a composite HRTF of a group of people. For example, the generic HRTF can have average values of the user group for one or more underlying parameters, such as inter-aural time difference (ITD), inter-aural level differences (ILD), and diffuse field HRTF (DF-HRTF).

An audio system and a method of using the audio system to determine an interaural head-related transfer function (HRTF) parameter specific to a user is described. By replacing or adapting generic HRTF parameters with user-specific HRTF parameters, an individualized HRTF can emerge. For example, an average ITD of a generic HRTF can be replaced by a measured ITD of a particular user to individualize the HRTF dataset to the user. When enough of the underlying parameters of the generic HRTF are personalized, the composite HRTF dataset should be indistinguishable from a measurement of the individualized HRTF of the user.

The method of determining the interaural HRTF parameter can include generating a binaural recording using microphones worn by a user. The microphones can be worn in the ears of the user, for example.

Several segments of the binaural recording can be selected based on a selection criteria. For example, the selection criteria can be a level threshold, an interaural coherence threshold, a match between the segment and a recorded sound profile, or any other method indicating that the recorded interaural cues correspond to free-field (reflection-free conditions). The selection criteria chooses segments that correspond to sounds emitted at intermittent time points by discrete sound sources located in a pseudo-anechoic environment. More particularly, the segments correspond to sounds generated randomly in an uncontrolled environment around the user.

An interaural parameter value can be measured for each of the selected segments. The interaural parameter value can be an ITD or an ILD of the measured segment. Accordingly, a group of interaural parameter values is accumulated over time, which provides information about an interaural parameter of the user, e.g., a minimum value, maximum value, or shape of a distribution of the measured parameter in all directions relative to the user.

Based on the measured interaural parameter values, an interaural HRTF parameter can be estimated. The estimated interaural HRTF parameter may be specific to the user. For example, the interaural HRTF parameter can be a maximum ILD or a maximum ITD of the user, extracted from the measured values, which can correspond to the ILD or ITD of the user when sounds are received from a particular direction.

A generic interaural HRTF parameter can be adapted based on the estimated interaural HRTF parameter to individualize an HRTF of the user. In an aspect, a generic HRTF is selected for the user, and the generic HRTF includes underlying generic HRTF parameters, such as a generic ITD. The generic HRTF parameter can be scaled or replaced by the estimated HRTF parameter that is user-specific to optimize the generic HRTF parameter for the user. Accordingly, an individualized HRTF of user can emerge for use in rendering binaural simulations to user.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Aspects describe an audio system and a method of using the audio system to determine an interaural head-related transfer function (HRTF) parameter. The audio system can incorporate a mobile device and microphones in respective earphones, such as earbuds. The audio system may, however, incorporate several microphones on a single headset, such as circumaural or supra-aural headphones, home audio systems, or any consumer electronics device with audio capability, to name only a few possible applications.

In various aspects, description is made with reference to the figures. However, certain aspects may be practiced without one or more of these specific details, or in combination with other known methods and configurations. In the following description, numerous specific details are set forth, such as specific configurations, dimensions, and processes, in order to provide a thorough understanding of the aspects. In other instances, well-known processes and manufacturing techniques have not been described in particular detail in order to not unnecessarily obscure the description. Reference throughout this specification to "one aspect," "an aspect," or the like, means that a particular feature, structure, configuration, or characteristic described is included in at least one aspect. Thus, the appearance of the phrase "one aspect," "an aspect," or the like, in various places throughout this specification are not necessarily referring to the same aspect. Furthermore, the particular features, structures, configurations, or characteristics may be combined in any suitable manner in one or more aspects.

The use of relative terms throughout the description may denote a relative position or direction. For example, "in front of" may indicate a first direction away from a reference point. Similarly, "behind" may indicate a location in a second direction away from the reference point and opposite to the first direction. Such terms are provided to establish relative frames of reference, however, and are not intended to limit the use or orientation of an audio system to a specific configuration described in the various aspects below.

In an aspect, an audio system makes and utilizes in-situ recordings at the ears of a listener in everyday scenarios. Acoustic signals recorded at the listeners ears contain reflections/diffractions around the listeners anatomy, and thus, contain key individualized parameters of the listener's individualized HRTF. A method is described for extracting the individualized HRTF parameter(s) and using the parameter(s) to generate a version of the individualized HRTF of the listener. The individualized HRTF version can be applied to audio inputs to provide realistic binaural renderings to the listener.

Figure 1:
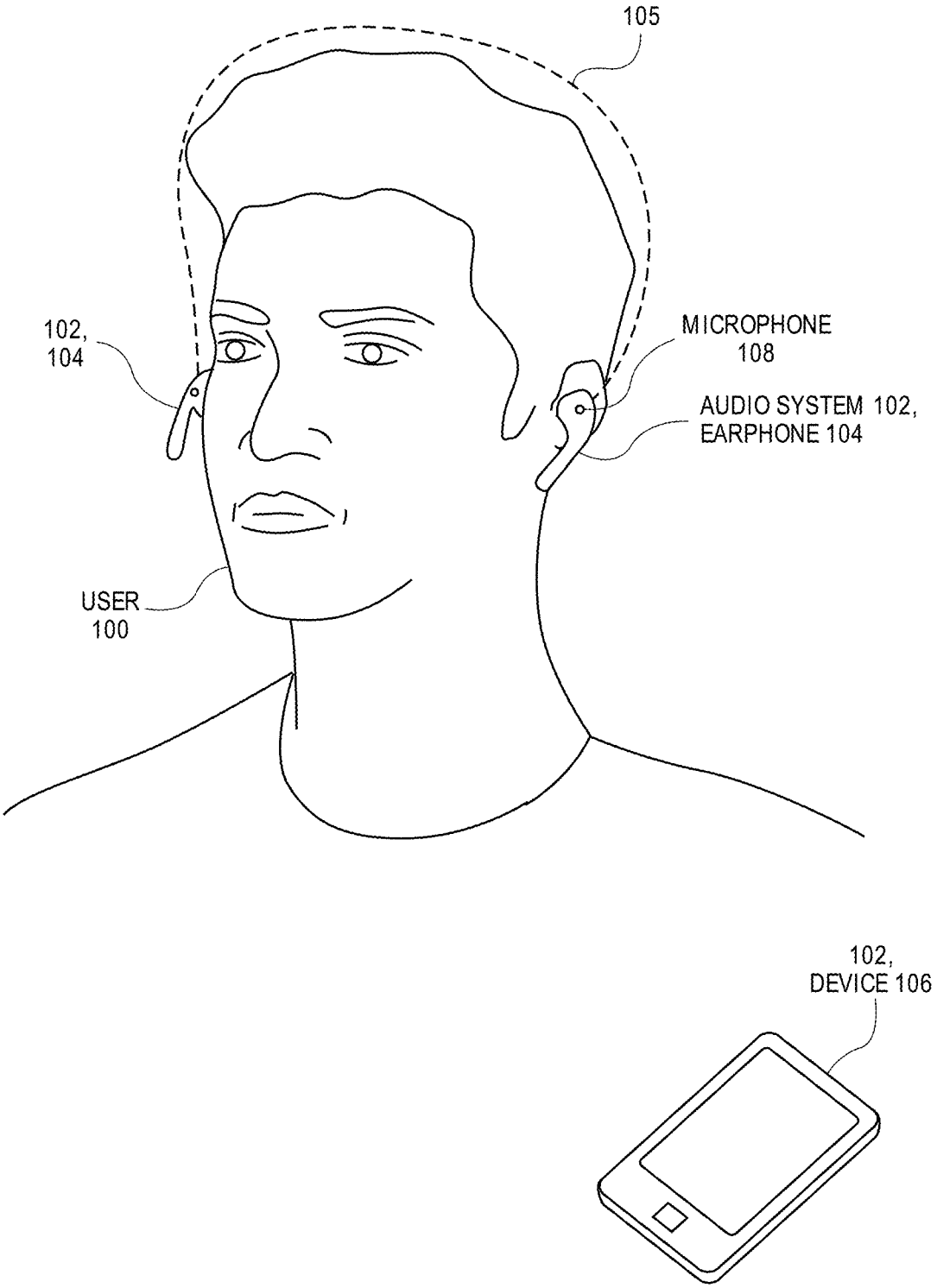
FIG. 1 is a pictorial view of a user listening to an audio system, in accordance with an aspect.

Referring to FIG. 1, a pictorial view of a user listening to an audio system is shown in accordance with an aspect. A user 100 of an audio system 102 can listen to audio, such as music, phone calls, etc., emitted by one or more earphones 104. More particularly, audio system 102 can include one or more speakers, such as electroacoustic transducers, to play an audio signal. Earphones 104 can be physically connected, e.g., by a headband or neck cord, to form a headset 105. Headset 105 can be a pair of circumaural or supra-aural headphones. In an aspect, audio system 102 includes a device 106, such as a mobile device, laptop, home stereo, etc., which generates the audio signal that is played by earphones 104. Earphones 104 can be connected to device 106 wirelessly or by a wired connection to receive the audio signal for playback.

Audio system 102 can include several microphones 108 to detect sounds in a surrounding environment and generate acoustic signals based on the sounds. For example, microphones 108 can be located on earphones 104 as close to the ear canal of user 100 as possible. Microphones 108 may receive a voice of user 100 during a phone call, or external sounds from sound sources within the surrounding environment. As described below, microphones 108 can generate a binaural recording representing the received sounds.

Figure 2:
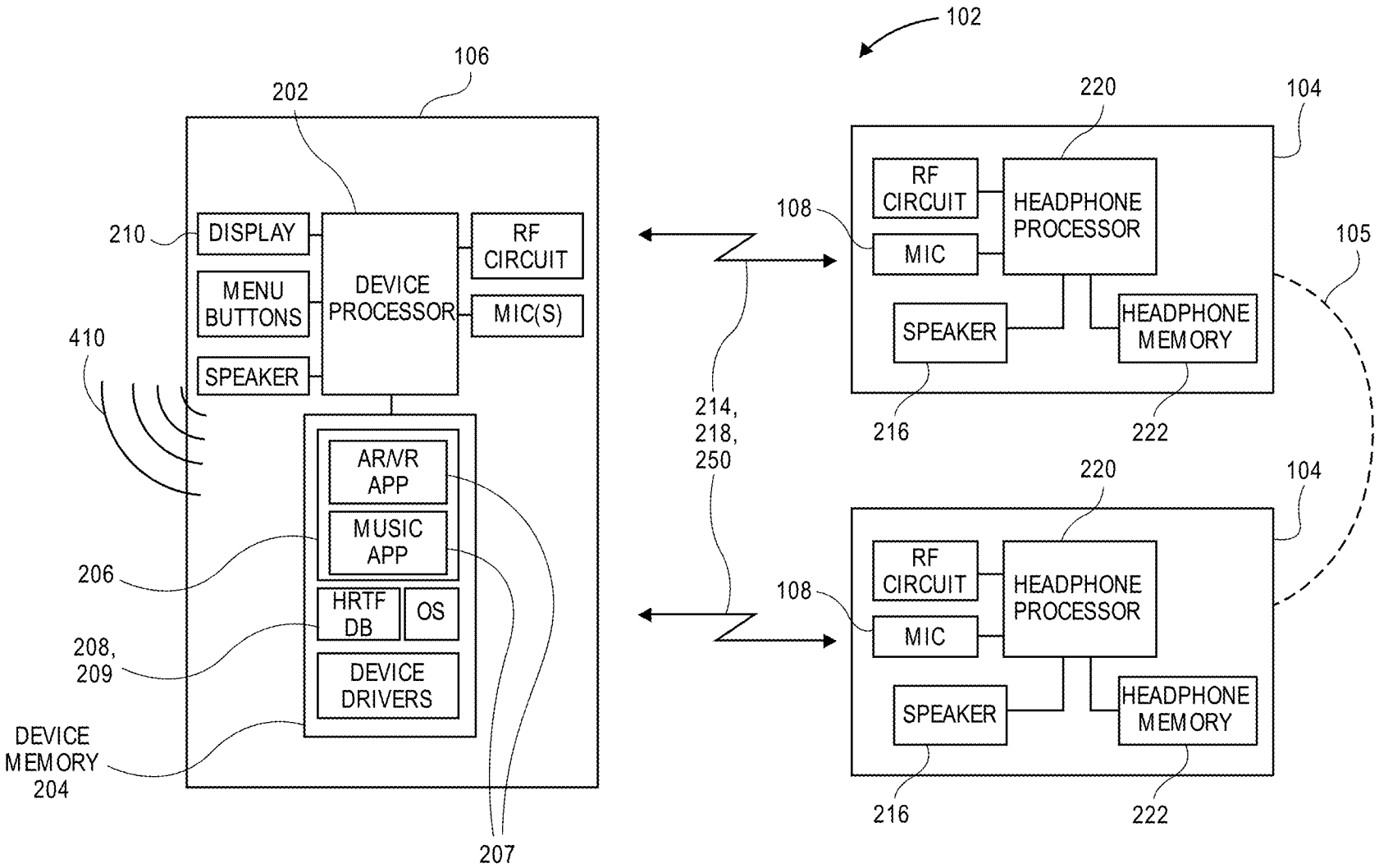
FIG. 2 is a block diagram of an audio system, in accordance with an aspect.

Referring to FIG. 2, a block diagram of an audio system is shown in accordance with an aspect. Audio system 102 can includes device 106, which can be a mobile device, e.g., any of several types of portable devices or apparatuses with circuitry suited to specific functionality. Accordingly, the diagrammed circuitry is provided by way of example and not limitation. Device 106 may include one or more device processors 202 to execute instructions to carry out the different functions and capabilities described below. Instructions executed by device processor(s) 202 of device 106 may be retrieved from a device memory 204, which may include a non-transitory machine-readable medium. The instructions may be in the form of an operating system program having device drivers and/or an audio rendering engine for rendering binaural playback according to the methods described below.

Device processor(s) 202 can retrieve audio data 206 from device memory 204. Audio data 206 may be associated with one or more audio sources 207, including phone and/or music playback functions controlled by the telephony or music application programs that run on top of the operating system. Similarly, audio data 206 may be associated with an augmented reality (AR) or virtual reality (VR) application program that runs on top of the operating system. The audio sources 207 can output user content signals 218 for playback by earphones 104.

In an aspect, device memory 204 stores HRTF-related data. For example, device memory 204 can store an HRTF database 208 or a sound classification profile 209. HRTF database 208 can include a dataset of generic or individualized HRTFs that correspond to specific locations relative to user 100. Sound classification profile 209 can be an acoustic profile of a predetermined sound, such as a profile of a dog bark in a time domain or a frequency domain. The utility of HRTF database 208 and sound classification profile 209 is described in detail below.

To perform the various functions described below, device processor(s) 202 may directly or indirectly implement control loops and receive input signals from and/or provide output signals to other electronic components. For example, device 106 may receive input signals from microphone(s) or menu buttons of device 106, including through input selections of user 100 interface elements displayed on a display 210. Device 106 and a headset 105 of audio system 102, e.g., one or more earphones 104, can communicate system signals 214. More particularly, device 106 and earphone 104 can communicate wirelessly via respective RF circuitry, or through a wired connection. Accordingly, voice commands received by microphone(s) 108 of headset 105 can be communicated as inputs to device 106. One or more of the various functions described below can also be performed by a headphone processor 220. For example, earphone 104 can include a headphone memory 222 to store audio data 206, e.g., a cached portion of user content signal 218 received from device 106, and an HRTF filter for a respective earphone 104. Headphone processor 220 can apply the HRTF filter to the cached portion when rendering binaural playback to user 100. In an aspect, all functionality of system 102 can be performed by the components in headset 105.

Speakers 216 can be connected to audio sources 207 of device 106 via communication circuitry, and accordingly, device 106 can output an audio signal to speakers 216 for playback. For example, speakers 216 can play user content signal 218 provided by the AR/VR application programs to render binaural playback to user 100. User content signals 218 can be transmitted from device 106 to headset 105 via a wired or wireless communication link. For example, the communication link can be established by a wireless connection using a Bluetooth standard, and device processor 202 can transmit user content signal 218 wirelessly to headphone processor 220 via the communication link.

User 100 may wear earphones 104 to listen to audio that has a spatialized or non-spatialized effect. For example, when user 100 is commuting to work, speakers 216 may render stereo music to listener without spatialization. At work, however, listener may engage in a phone call in which earphones 104 render a voice of a caller with spatialization such that the caller appears to be speaking to user 100 from a location external to the user's head. Spatialization may be based on a generic HRTF that is selected for user 100 based on some predetermined anatomical parameters, such as a width of the user's head. As described above, however, the generic HRTF may introduce anomalies that are inconsistent with a true HRTF of the user 100, and accordingly, the user 100 may not experience the spatialized effect as intended.

The generic HRTF can be adapted to better fit user 100. Such optimization, however, requires measurement and/or determination of HRTF parameters that are specific to user 100. A method of using audio system 102 to determine interaural HRTF parameters specific to user 100 includes taking moments of opportunity to record sounds at the user's ears. The recordings are then measured to determine individualized HRTF parameters of the user 100.

Figure 3:
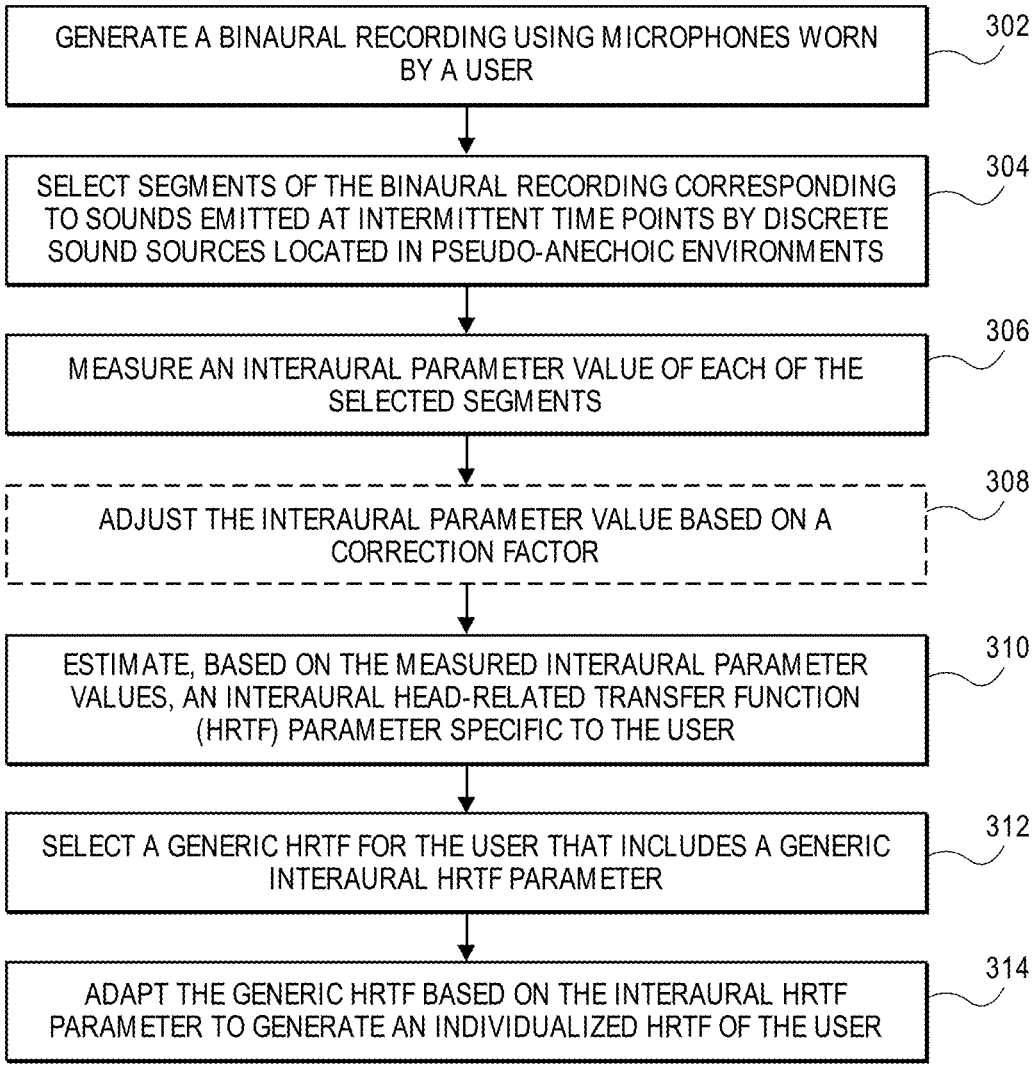
FIG. 3 is a flowchart of a method of determining an interaural head-related transfer function (HRTF) parameter, in accordance with an aspect.

Referring to FIG. 3, a flowchart of a method of determining an interaural head-related transfer function (HRTF) parameter is shown in accordance with an aspect. The operations of the method of FIG. 3 relate to aspects shown in FIGS. 4-11, and accordingly, FIGS. 3-11 are described in combination below.

At operation 302, a binaural recording is generated by microphones 108 worn by user 100. Microphones 108 can be housed within earphones 104, which may be in-ear earphones 104. Microphones 108 may be exposed to a surrounding environment. Accordingly, microphones 108 can detect sounds and generate in-situ binaural recordings of the sounds at or near the ear-canal entrance of user 100. The recordings can be made in everyday listening conditions. For example, the recordings can be continuously or intermittently generated by microphones 108 and stored in memory of device 106 and/or earphones 104 as user 100 commutes to work, walks through a city park, or relaxes in the evening. Any moment in which the user 100 is wearing earphones 104 is a moment that in-situ binaural recordings can be made by audio system 102.

Figure 4:
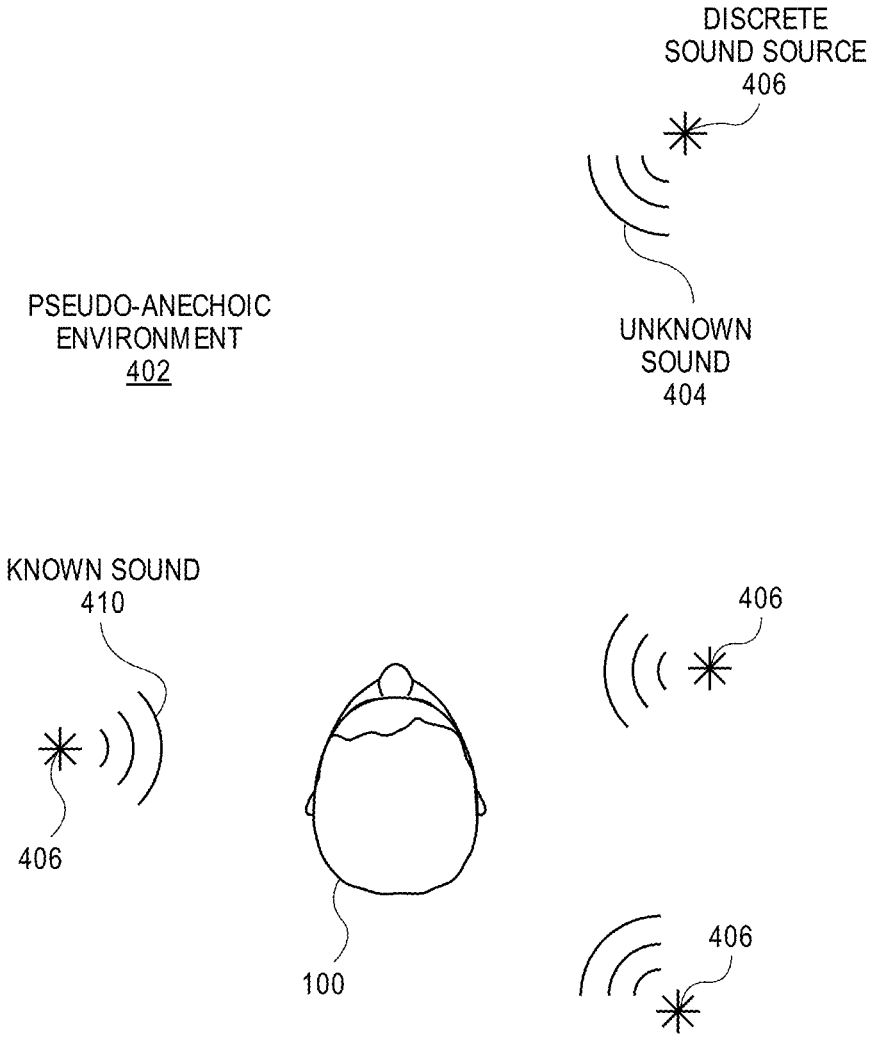
FIG. 4 is a pictorial view of a user in a pseudo-anechoic environment, in accordance with an aspect.

Referring to FIG. 4, a pictorial view of a user in a pseudo-anechoic environment is shown in accordance with an aspect. As used herein, a pseudo-anechoic environment 402 is a listening environment that approximates an anechoic environment. The pseudo-anechoic environment 402 may not be entirely anechoic. For example, user 100 may be walking through a city park among trees and other pedestrians while microphones 108 generate the binaural recording. As a result, sounds may reflect from sparsely planted trees, benches, or other items in the user's surroundings, but the acoustic energy received by user 100 from these reflections may be substantially less than the energy received from the sound directly. Accordingly, the pseudo-anechoic environment 402 approximates a free field listening environment.

The binaural recordings generated by microphones 108 can include segments that correspond to sounds emitted around user 100. The sounds captured in the binaural recordings can be extremely varied in nature. For example, the sounds can have substantial changes in level, frequency content, and spatial distribution. This variation stems from a diversity in the sound sources that emit the sounds. More particularly, by capturing binaural recordings in a real-world environment (as opposed to within an anechoic chamber designed for the purpose of evaluating HRTFs using predetermined sound sources in a controlled environment), the recordings will include a mixture of non-discrete sounds such as the rustling of leaves or the babbling of a brook, and discrete sounds such as the bark of a dog or the alert sounds of a device.

In an aspect, the sounds emitted in the uncontrolled pseudo-anechoic environment 402 are unknown sounds 404. That is, user 100 and/or audio system 102 may have no knowledge or information regarding the sound source stimulus and direction that is captured on the binaural recording. As a result, direct HRTF measurement is not possible. Nonetheless, an interaural transfer function of user 100 can be estimated based on the recorded sounds using the method described below.

At operation 304, one or more portions, e.g., segments, of the binaural recording are selected based on a selection criteria. The selection criteria may be used to select portions of the recording that correspond to sounds emitted at intermittent time points by discrete sound sources 406 located in pseudo-anechoic environment 402. Although sounds recorded from pseudo-anechoic environment 402 in real world scenarios are unknown to user 100 and/or audio system 102, it may nonetheless be possible to determine whether the unknown sounds 404 are emitted by a discrete sound source 406. Discrete sound sources 406 may be non-ambient sound sources that generate transient signals. For example, the sound of a dog barking may be a trusted discrete sound source 406. Characteristics of sounds from discrete sound sources differ from characteristics of sounds from non-discrete sound sources. For example, the signal characteristics of a discrete sound source, e.g., frequency characteristics, level, or interaural coherence, may differ from the signal characteristics of a non-discrete sound source. Over time, sounds from several discrete sound sources 406 can be recorded. The accumulated sound recordings from discrete sound sources 406 provide raw information about the signal characteristics of the sounds and how user 100 hears the sounds. The sounds can be recorded over a long period of time, e.g., over an indefinite period of time, and analyzed to compare left and right channels of the binaural recording.

Figure 5:
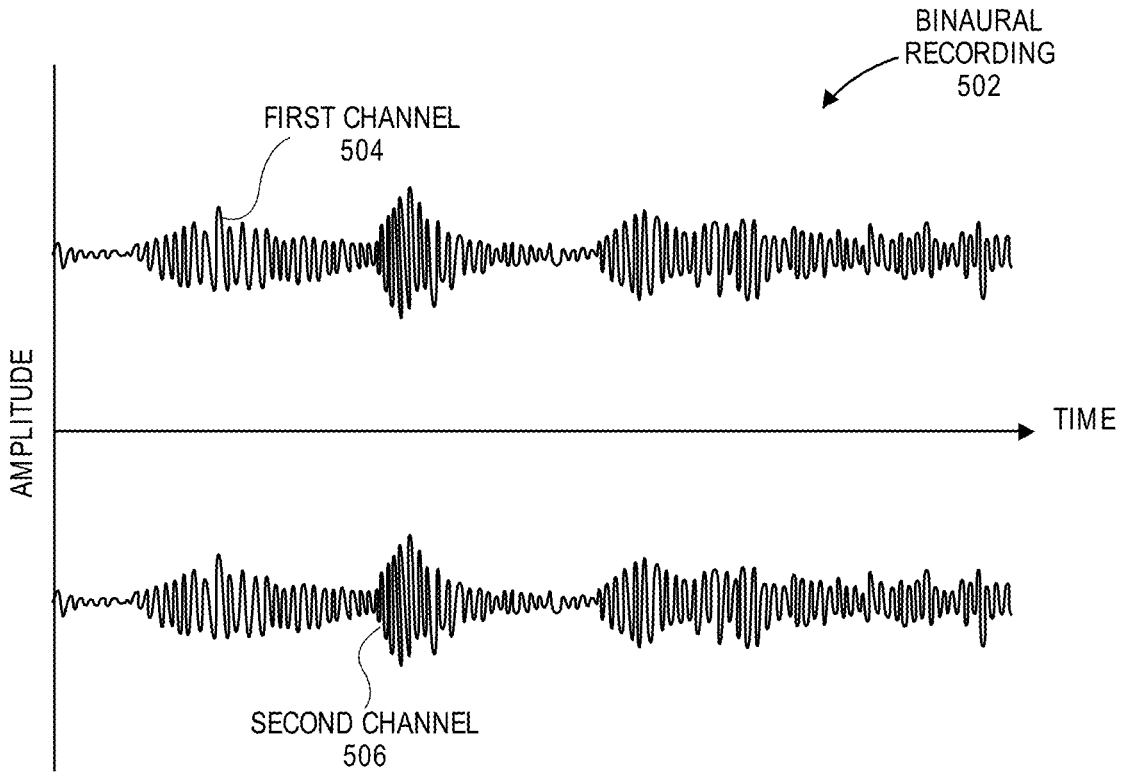
FIG. 5 is a graphical view of a time domain of a binaural recording, in accordance with an aspect.

Referring to FIG. 5, a graphical view of a time domain of a binaural recording is shown in accordance with an aspect. A binaural recording 502 includes two channels, e.g., a first channel 504 corresponding to a first earphone 104 worn in user's left ear and a second channel 506 corresponding to a second earphone 104 worn in user's right ear. The recorded signals of each channel correspond to sounds received at the earphones 104. For example, when discrete sound source 406 emits unknown sound 404 in pseudo-anechoic environment 402, unknown sound 404 is detected by the right earphone 104 to generate the right channel recording and unknown sound 404 is detected by the left earphone 104 to generate the left channel recording. A combination of the individual channels provides binaural recording 502 that is generated by earphones 104.

Acoustic signals recorded from discrete sound source 406 by the left earphone 104 and the right earphone 104 may differ. When discrete sound source 406 is located to the side of a sagittal plane of user 100, unknown sound 404 will arrive at one of the earphones 104 before the other. For example, when discrete sound source 406 is on a right side of the plane, unknown sound 404 will arrive at the right earphone 104 first. The difference in arrival time of unknown sound 404 at the left ear and the right ear corresponds to an interaural time difference (ITD) of user 100. Similarly, a difference in sound level detected at the left ear and the right ear corresponds to an interaural level difference (ILD). These differences between the left channel and the right channel can be measured for discrete sound sources 406 that occur randomly in time. By measuring such events repeatedly over time, an interaural transfer function can be estimated, as described below.

Figure 6:
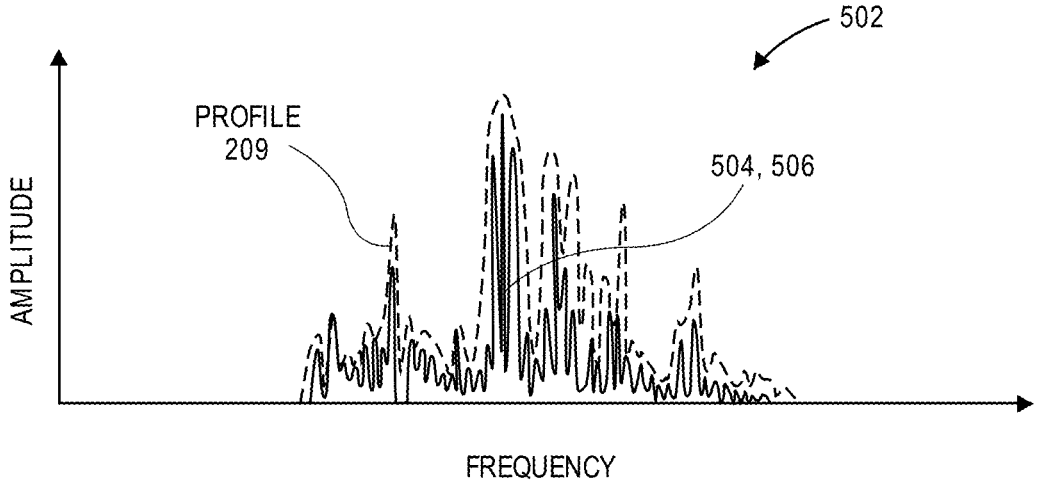
FIG. 6 is a graphical view of a frequency domain of a binaural recording, in accordance with an aspect.

Referring to FIG. 6, a graphical view of a frequency domain of a binaural recording is shown in accordance with an aspect. Binaural recording 502 can also be analyzed in the frequency domain. More particularly, whereas FIG. 5 represents a change of the recorded signals over time, the frequency domain graph represents a distribution of levels of frequency bands within a frequency range of unknown sound 404. Comparisons of the frequency domain of each channel can be used to determine whether the channels have received the same sound, and may be referenced to the time domain to determine when the same sound arrived at each earphone 104.

Although binaural recording 502 may capture unknown sounds 404, which have an unknown relative position relative to user 100 and an unknown source, a selection criteria may be used to select portions of binaural recording 502 that correspond to discrete sound sources 406. In an aspect, segments of binaural recording 502 can be selected for further use based on whether the sound captured in the binaural recording 502 matches a predetermined sound. The selection criteria can be the match between the recording and the predetermined sound. For example, certain sounds that can be expected to occur outside of the controlled environment of anechoic chambers, such as a dog bark, can be prerecorded and profiled. More particularly, the predetermined sound recording, such as the dog bark recording, can be graphed in the frequency domain to generate predetermined sound classification profile 209. The profile can be stored in device memory 204 and/or headphone memory 222. The dog bark can be profiled in other manners, however, in any case predetermined sound classification profile 209 is compared to a graphical representation of first channel 504 or second channel 506 recordings. When a segment of binaural recording 502 includes a recording of a barking dog, one or more of first channel 504 or second channel 506 (or an average of the channels) will match sound classification profile 209. Accordingly, the segment containing the matching recording can be selected as a discrete sound source 406. The selection of the segment may be used as a preselection criteria. For example, the preselected segments that appear to match a prerecorded sound can be passed on for additional processing using interaural coherence criteria as described below. Alternatively, the selected segment may be passed for additional processing at operation 306 described below.

Sound classification profile 209 can be for any sound that can be trusted as being from a discrete sound source 406. For example, sounds that are from discrete sound sources 406 tend to be both noisy and transient. Such sounds can be recorded and used for signal processing. A dog bark is an example of a noisy and transient sound, but others exist that can work equally well.

Figure 7:
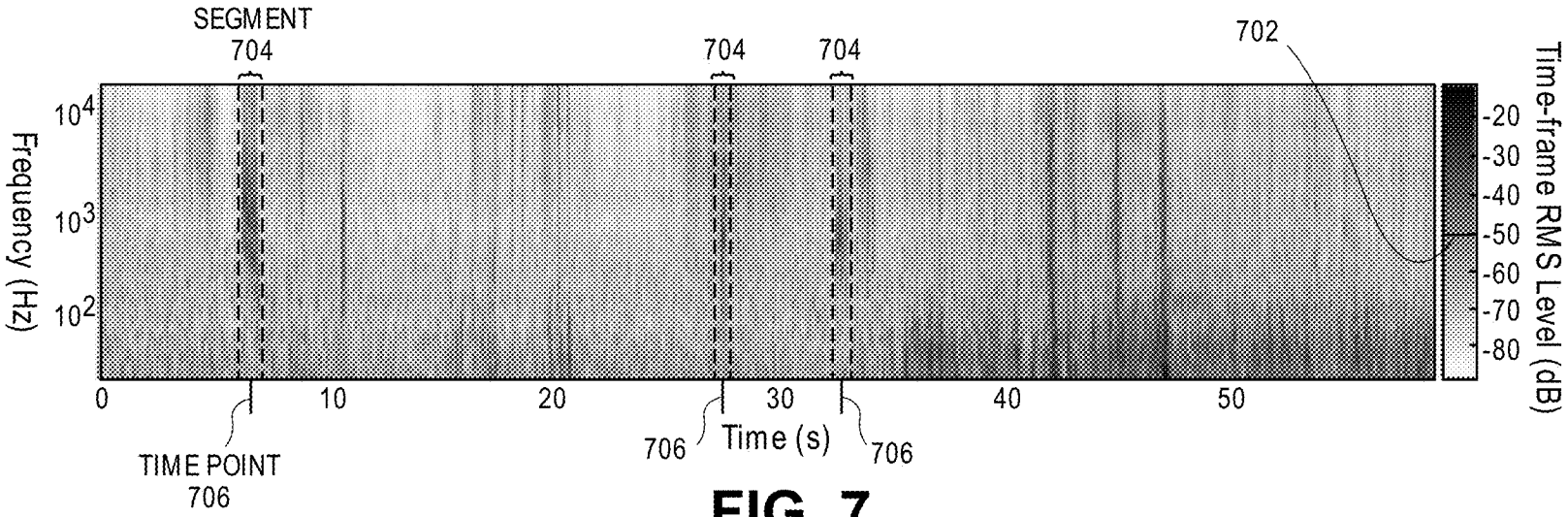
FIG. 7 is a graphical view showing a root mean square level of a binaural recording, in accordance with an aspect.

Referring to FIG. 7, a graphical view shows a root mean square level of a binaural recording in accordance with an aspect. The selection criteria for selecting recorded segments may be based on a loudness of binaural recording 502. For example, the selection criteria may include a loudness threshold 702, which is a predetermined root mean squared (RMS) level, e.g., in decibels. When an amplitude of a particular frequency band in a segment 704 of binaural recording 502 is above loudness threshold 702, e.g., when segment 704 has a predetermined level of loudness, segment 704 can be selected as likely corresponding to a discrete sound source 406. By way of example, each segment 704 shown at intermittent time points 706 having RMS levels above loudness threshold 702 of −50 decibels can be selected. The selected segments 704 are assumed to include a trusted type of sound that can be used further. Loudness threshold 702 can be set to other levels, depending upon the degree of selectivity that is desired.

Figure 8:
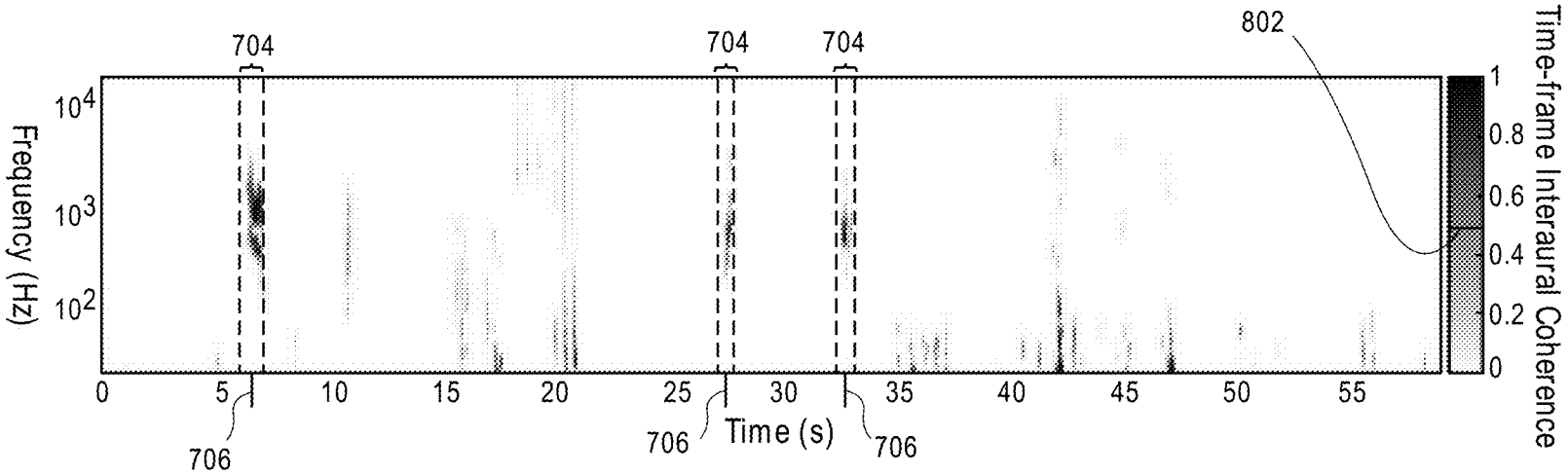
FIG. 8 is a graphical view showing an interaural coherence of a binaural recording, in accordance with an aspect.

Referring to FIG. 8, a graphical view shows an interaural coherence of a binaural recording in accordance with an aspect. Selection criteria used to select segments 704 of binaural recording 502 may be based on a degree of correlation between the channels generated by the left and right microphones 108. When a sound signal is coming from a specific location, e.g., from a discrete sound source 406 at a single location rather than from many locations, the acoustic signal received at the left ear and the right ear of user 100 are approximately the same. In this case, the recording channels spatially correlate. For example, as shown in FIG. 6, the frequency domain graph of the left and right channels that receive a same unknown sound 404 are similar. A degree of similarity can be determined by determining the interaural coherence of the channel recordings. For example, the selection criteria may include an interaural coherence threshold 802, which is a predetermined correlation on a scale of 0 to 1. When the cross-correlation between certain frequencies in both channels is above interaural coherence threshold 802, e.g., when segment 704 has a predetermined degree of similarity in certain frequency bands, segment 704 can be selected as likely corresponding to a discrete sound source 406. By way of example, each segment 704 shown at intermittent time points 706 has interaural coherence above interaural coherence threshold 802, e.g., 0.6. The segments 704 can be selected because the interaural coherence values of the segments 704 are above interaural coherence threshold 802. Accordingly, the selected segments 704 are determined to be a trusted type of sound that can be used further. Interaural coherence threshold 802 can be set to other levels, depending upon the degree of selectivity that is desired. Portions of binaural recording 502 that have interaural coherence below interaural threshold can be rejected for further use based on a likelihood that the portions are tainted by reverberation or other anomalies, and thus, are likely not free field measurements in pseudo-anechoic environments 402 that can be trusted for further use as described below.

Figure 9:
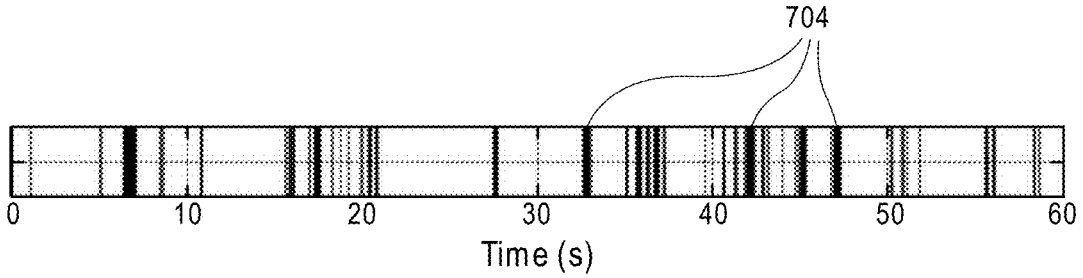
FIG. 9 is a graphical view showing selected segments of a binaural recording, in accordance with an aspect.

Referring to FIG. 9, a graphical view of selected segments shows a binaural recording in accordance with an aspect. Several segments 704 of binaural recording 502 can be selected using one or more of the selection criteria described above. The vertical bands shown on the timeframe represent segments 704 of time in binaural recording 502 that include acoustic signals that are likely to be a trusted type of sound. When segments 704 of binaural recording 502 are selected as corresponding to valid binaural events using one or more of the auditory event selection criteria described above, audio system 102 can progress to further use of the selected segments 704 as described below.

At operation 306, an interaural parameter value of each selected segment 704 is measured. The measured interaural parameter value can be an underlying parameter of an individualized HRTF of user 100.

Figure 10:
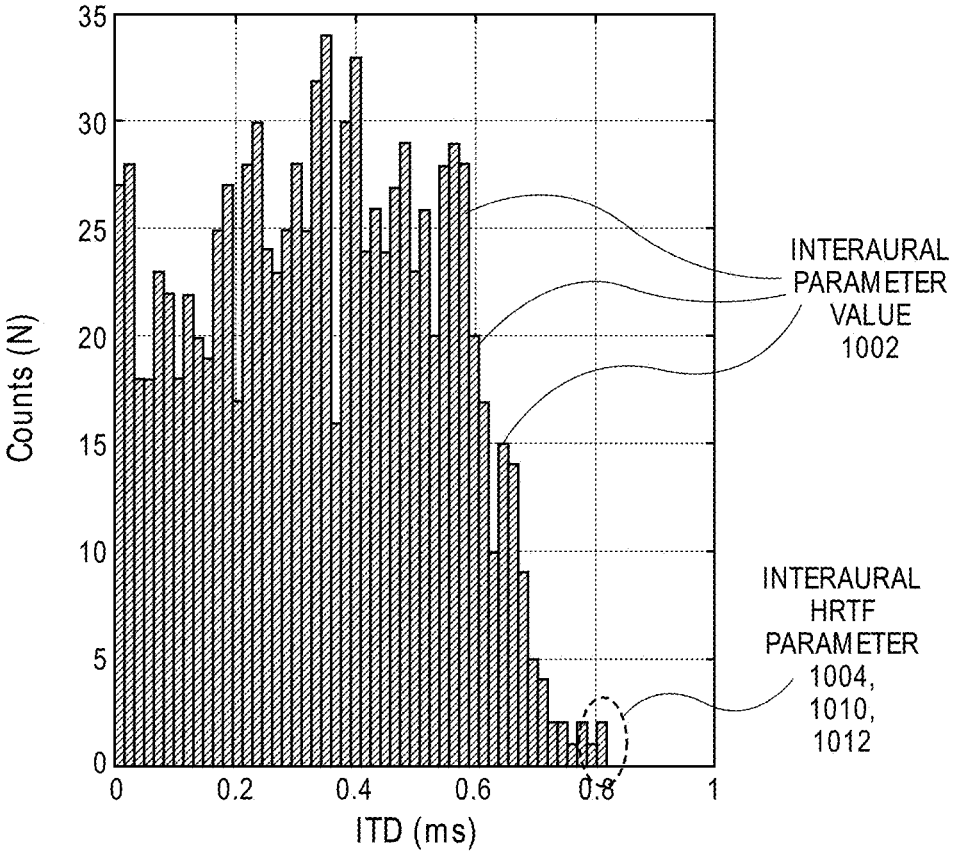
FIG. 10 is a graphical view showing measured interaural parameter values for selected segments of a binaural recording, in accordance with an aspect.

Referring to FIG. 10, a graphical view shows measured interaural parameter values for selected segments of a binaural recording in accordance with an aspect. Segments 704 of binaural recording 502 representing valid binaural events can be used to calculate interaural features of the individualized HRTF of user 100. For example, HRTF features can be extracted from segments 704 based on differences between the left channel and the right channel in each segment 704. These differences can include time or level differences across frequencies.

An interaural parameter value 1002 of each segment 704 can be measured to build a data set of features corresponding to a group of discrete sound sources 406 that occur randomly in time. By measuring the events repeatedly over time, the data set can approximate all possible frequencies and directions of impinging sounds. More particularly, although the direction of unknown sounds is not determined by audio system 102, the ability of audio system 102 to gather data over long periods of time ensures that the recorded segments 704 include sounds coming from discrete sound sources 406 in nearly all directions around user 100.

A histogram of interaural parameter values 1002 for the ITD of user 100 includes many samples having respective measurements. In an aspect, a predetermined minimum number of interaural parameter value 1002 measurements can be made to ensure that sufficient data is relied upon when estimating an interaural HRTF parameter 1004, as described below. For example, the number of interaural parameter value 1002 measurements can be a number of measurements of randomly generated sounds such that the selected binaural events are distributed between 0 to 360 degrees in azimuth and −30 to 30 degrees in elevation around user 100. To achieve this distribution, the minimum number can be at least 500 measurements, for example. With such a large group, it can be assumed that the measurements represent discrete sound sources 406 distributed in all directions around user 100, even the directionality of sounds is not actually determined by audio system 102. The predetermined minimum number can be set based on a minimum degree of confidence that is required to accurately estimate the interaural parameter of user 100. Event selection and measurement, however, may continue beyond the minimum number to incrementally build the data set and improve the confidence level in the HRTF parameter estimation.

The measurement of interaural HRTF parameter 1002 using microphones 108 of device 102 may not accurately represent the actual interaural HRTF parameter at the entrance to the ear canals of user 100. Microphones 108 may not be exactly located at the ear canal entrance. Accordingly, microphones 108 may be placed on earphones 104 wider than the user's ears and offset from the ear canal entrances. In such case, the measured interaural HRTF parameter 1002 can differ from the actual interaural HRTF parameter. For example, the measured ITD may be larger than the actual ITD based on a distance between microphone 108 and the ear canal entrance.

At operation 308, interaural HRTF parameter 1002 measurements can, optionally, be adjusted to more accurately represent the actual interaural HRTF parameter. In an aspect, a translation between the interaural HRTF parameter 1002 measurements and the actual interaural HRTF parameter is performed using a correction factor. For example, the correction factor can be determined by measuring the interaural HRTF parameter at the microphone 108 and at the ear canal entrance for a number of people. The differences between the measurements can be used to determine the correction factor, e.g., based on an average of the percent difference between the parameter value measured at the ear canal and at the microphone locations. Accordingly, the correction factor can be applied to interaural HRTF parameter 1002 measurements obtained by microphones 108 to determine the actual interaural HRTF parameter values for user 100. The adjustment of the interaural parameter values based on the correction factor can be performed for any interaural parameter or microphone position. Accordingly, the estimation of interaural HRTF parameter 1004 described below can be based on the measured parameter values 1002 and/or the actual parameter values determined by adjusting the measured values using the correction factor.

At operation 310, an interaural HRTF parameter 1004 can be estimated based on the measured interaural parameter values 1002. Interaural parameter values 1002 can be measured ITD values (or corrected ITD values) for unknown sounds 404 having random directions, as shown in the histogram of FIG. 10. ITD can be decoupled from other HRTF features, and accordingly, is a suitable HRTF feature for extraction from the data set. Interaural parameter values 1002 may be measurements of a different interaural measurement, however, such as ILD values for unknown sounds 404. In any case, the generated data set of interaural parameter values 1002 can be used to determine interaural HRTF parameter 1004.

In an aspect, interaural HRTF parameter 1004 is a maximum interaural HRTF parameter specific to user 100. For example, interaural HRTF parameter 1004 can be a maximum ITD 1012 or a maximum ILD 1010 of user 100. The maximum value can be based on all measurements, which represent discrete sound sources 406 in all directions. More particularly, the maximum interaural parameter value 1002 is not associated with a particular location during the recording, selection, and determination phases. The maximum interaural parameter value 1002 may, however, be assumed to be associated with an assumed direction. For example, in the case of ITD measurements, when interaural parameter values 1002 are at a maximum, it can be assumed that the values correspond to sounds arriving at the +/−90 degree azimuth direction, e.g., directly left or right of user 100. Similarly, when interaural parameter values 1002 are at a minimum, it can be assumed that the values correspond to sounds arriving at the 0 or 180 degree azimuth direction, e.g., directly in front of or behind user 100.

One or more minimum values of ITD or ILD may also be estimated as interaural HRTF parameter 1004. The minimum values for different interaural parameters do not necessarily co-occur. For example, a sound event corresponding to a minimum value of ITD may not necessarily correspond to a minimum value of ILD. A detailed account of this discrepancy can itself be used as an interaural HRTF parameter. More particularly, an asymmetry profile for ITD and ILD values can be used to adapt a generic HRTF.

Figure 11:
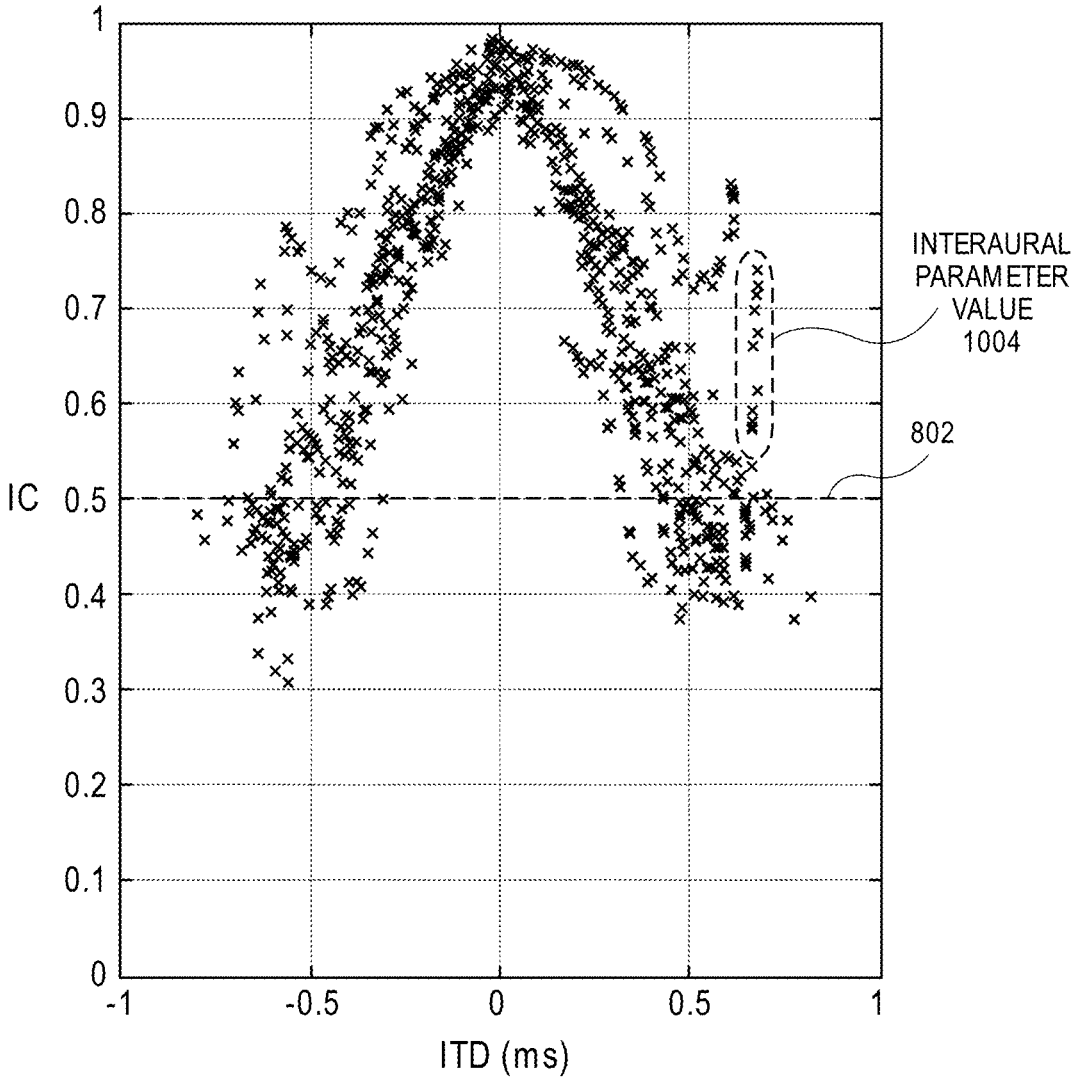
FIG. 11 is a graphical view showing a scatterplot of interaural parameter values for selected segments of a binaural recording, in accordance with an aspect.

Referring to FIG. 11, a graphical view shows a scatterplot of interaural parameter values for selected segments of a binaural recording in accordance with an aspect. Another group of data that can be used to predict maximum interaural HRTF parameters 1004 can include valid binaural event data having both interaural parameter values 1002, e.g., ITD, and interaural coherence values. Estimation of interaural HRTF parameter 1004 may be based on criteria associated with these parameters. For example, the estimated interaural HRTF parameter 1004 may be selected from one or more data points having interaural coherence above interaural coherence threshold 802, which also meet an interaural parameter selection criteria. For example, the interaural parameter selection criteria may be that interaural HRTF parameter 1004 is a value of a group of data points of a particular size. More particularly, data points that have a group size, e.g., at least 5 data points, of a same ITD can be used as the maximum ITD 1012, if the group has interaural coherence values above threshold 1002. Although this maximum ITD 1012 may not technically be a maximum, given that other data points above interaural coherence threshold 802 have larger ITDs, the use of the value of the group having a minimum size may provide a more reliable estimation that can eliminate outlier values.

It is noted that the interaural parameter values of FIG. 11 are symmetric about an ITD value of zero, and accordingly, maximum interaural HRTF parameter 1004 can be an absolute value. That is, in an aspect, maximum interaural HRTF parameter 1004 can be based on values of a group having negative ITD values. The absolute value of the negative ITD values, however, may be greater than those of the circled group in FIG. 11. Accordingly, maximum interaural HRTF parameter 1004 can be based on absolute values in the scatterplot.

The estimated interaural HRTF parameter 1004 can be used to optimize an HRTF-based rendering algorithm. More particularly, after specific features of HRTF, e.g., interaural HRTF parameter 1004, are known, the parameters can be used to create an individualized HRTF for user 100. As described below, generation of the individualized HRTF can include HRTF selection and/or HRTF modification.

At operation 312, a result of the interaural parameter measurements and estimations may be used to select a particular HRTF. For example, the particular HRTF can be a generic HRTF for user 100. Generic HRTF's can be predetermined HRTF profiles that are expected to fit users based on their known anatomical characteristics. For example, users having a particular head or ear size or shape may be grouped together and served a respective generic HRTF when performing binaural rendering. The generic HRTF can be stored in HRTF database 208 for selection based on the anatomical characteristics. Each generic HRTF can include an underlying ITD or ILD parameter. In an aspect, selection of the generic HRTF for user 100 can include selecting the generic HRTF that has a generic interaural HRTF parameter that matches the estimated interaural HRTF parameter 1004 from operation 310. Given that the estimated interaural HRTF parameter 1004 is data-driven and based on long-term measurements specific to user 100, it may be a better proxy for the generic HRTF than, for example, a width of the head of user 100. In an aspect, the selected generic HRTF may be used as the individualized HRTF that can be applied to input signals, e.g., user content signal 218, to render a binaural acoustic output to user 100. Additional processing of the generic HRTF according to the operations described below may be used, however, to further optimize the individualized HRTF for user 100.

At operation 314, the generic HRTF can be adapted based on interaural HRTF parameter 1004 estimated at operation 310. The adaptation of the generic HRTF can include personalizing features of the HRTF. For example, the generic HRTF may be selected based on the anatomical characteristics of user 100, and may have one or more generic interaural HRTF parameters, such as a generic ITD or a generic ILD parameter. The one or more generic interaural HRTF parameters can be modified based on the estimated interaural HRTF parameter 1004 to generate an individualized HRTF.

In an aspect, the generic interaural HRTF parameter(s) are adjusted based on the estimated interaural HRTF parameter 1004 to generate the individualized HRTF. For example, after estimating interaural HRTF parameter 1004 specific to user 100, the underlying parameters of the generic HRTF may be adjusted, while other parameters of the HRTF are unchanged. When interaural HRTF parameter 1004 is an ITD of user 100, the generic ITD value of the generic HRTF can be scaled or replaced by the estimated ITD of user 100. When interaural HRTF parameter 1004 is an ILD of user 100, the generic ILD value of the generic HRTF can be corrected based on the extracted ILD of user 100. Accordingly, the individualized HRTF of the user 100 can be generated by adapting the generic HRTF.

In an aspect, the generic interaural HRTF parameter(s) are replaced by the estimated interaural HRTF parameter 1004 to generate the individualized HRTF. For example, after estimating interaural HRTF parameter 1004 specific to user 100, the underlying parameters of the generic HRTF may be replaced by the estimated interaural HRTF parameters 1004, while other parameters of the generic HRTF are unchanged. When interaural HRTF parameter 1004 is an ITD of user 100, the generic ITD value of the generic HRTF can be replaced by the estimated ITD of user 100. When interaural HRTF parameter 1004 is an ILD of user 100, the generic ILD value of the generic HRTF can be replaced by the extracted ILD of user 100. Accordingly, the individualized HRTF of the user 100 can be generated by adapting the generic HRTF.

When an optimized HRTF is selected and/or personalized to generate the individualized HRTF of user 100, audio system 102 can use the individualized HRTF to render binaural audio to user 100. Binaural rendering of audio to user 100 can include applying the individualized HRTF to audio data 206 stored in device memory 204. For example, device 106 can generate the individualized HRTF and apply the HRTF to user content signal 218. User content signal 218 can be transmitted to earphones 104 for playback to user 100. The reproduced audio, which is based on the individualized HRTF that is optimized over time based on real world measurements, can improve an illusion of external sound sources in spatial audio and improve the overall sound quality experienced by user 100. The improvement can be transparent to user 100 because binaural recordings 502 are recorded, measured, and utilized in an uncontrolled environment without requiring input from user 100. Accordingly, the individualized HRTF can be generated seamlessly and with relative ease as compared to developing an HRTF for user 100 in a controlled laboratory setting.

Referring again to FIG. 4, sounds captured in binaural recording 502 may be known sounds 410, rather than unknown sounds 404 as described above. More particularly, microphones 108 can generate binaural recording 502 having segments 704 corresponding to a known sound 410. Known sound 410 can be a sound emitted by a discrete sound source 406 of a known origin. For example, as shown in FIG. 2, device 106 can include one or more speakers. The speakers can emit predetermined sounds 410, such as system alerts. By way of example, system alerts can include chimes, rings, or vibrations associated with incoming calls, reminders, etc. These sounds can be captured on binaural recording 502.

Known sounds 410 may be predetermined acoustic signals and can have predetermined characteristics. For example, a chime that is emitted by device 106 as a system alert will be well characterized in the time and frequency domain. By capturing the chime on binaural recording 502, the chime can be identified in the recording based on the predetermined characteristics, e.g., the profile of the predetermined acoustic signal.

Known sounds 410 can be used to measure interaural parameter values 1002 or estimate interaural HRTF parameter 1004 in much the same way that unknown sounds 404 are used for that purpose. In an aspect, however, segments 704 of binaural recording 502 corresponding to known sounds 410 can be selected based on a selection criteria that is independent of a comparison between the left and right channel. For example, the selection criteria can be a notification 250 that indicates emissions of the known sounds 410 by device 106.

The known sounds 410 can be emitted by device 106 at intermittent time points 706 that are known in advance. For example, when an incoming call arrives at a mobile device 106, device 106 would emit a ring sound soon afterward. The ring is controlled by device 106, and accordingly, device 106 can send a notification 250 before or after the ring, which identifies a time at which the ring was emitted. For example, the ring could occur and device 106 can send notification 250 three seconds later indicating that the ring was emitted three second before. Headphone processor 220 or device processor 202 can receive notification 250 and use the indicated time to select segment 704 of binaural recording 502 that corresponds to the time of emission. Accordingly, notifications 250 provide information about segments 704 of binaural recording 502 that correspond to the intermittent time points 706 at which known sounds 410 are generated. Known sounds 410 can be reliable and trusted discrete sound sources 406, and thus, segments 704 corresponding to known sounds 410 can be measured to determine interaural parameter values 1002 and to estimate interaural HRTF parameter 1004 using the methodologies described above.

A relative position and/or orientation of user 100 with respect to discrete sound source 406 may be determined using tracking systems. For example, audio system 102 can include an optical tracking system or a positional tracking system to determine the relative position and/or orientation. In an aspect, the tracking system can include one or more cameras, e.g., in device 106, connected to one or more processors of audio system 102, e.g., device processor 202. The cameras can capture images of earphones 104 and/or user 100 to determine a relative position between device 106 and earphones 104 to allow for more controlled conditions. More particularly, by determining the relative direction of known sound 410 to user 100 using the image data, a specific relative angle can be associated with an interaural parameter value. The interaural parameter values can be used to estimate interaural HRTF parameter 1004 using the methodologies described above. The interaural parameter HRTF 1004 can be assigned to a known direction based on the information obtained from the tracking system. Accordingly, precise and detailed estimates of interaural HRTF parameter 1004 can be made.

As described above, one aspect of the present technology is the gathering and use of data available from various sources to estimate a user-specific interaural HRTF parameter. The present disclosure contemplates that in some instances, this gathered data may include personal information data that uniquely identifies or can be used to contact or locate a specific person. Such personal information data can include demographic data, location-based data, telephone numbers, email addresses, TWITTER ID's, home addresses, data or records relating to a user's health or level of fitness (e.g., vital signs measurements, medication information, exercise information), date of birth, or any other identifying or personal information.

The present disclosure recognizes that the use of such personal information data, in the present technology, can be used to the benefit of users. For example, the personal information data can be used to estimate a user-specific interaural HRTF parameter. Accordingly, use of such personal information data provides an improved spatial audio experience to the user. Further, other uses for personal information data that benefit the user are also contemplated by the present disclosure. For instance, health and fitness data may be used to provide insights into a user's general wellness, or may be used as positive feedback to individuals using technology to pursue wellness goals.

The present disclosure contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure. Such policies should be easily accessible by users, and should be updated as the collection and/or use of data changes. Personal information from users should be collected for legitimate and reasonable uses of the entity and not shared or sold outside of those legitimate uses. Further, such collection/sharing should occur after receiving the informed consent of the users. Additionally, such entities should consider taking any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices. In addition, policies and practices should be adapted for the particular types of personal information data being collected and/or accessed and adapted to applicable laws and standards, including jurisdiction-specific considerations. For instance, in the US, collection of or access to certain health data may be governed by federal and/or state laws, such as the Health Insurance Portability and Accountability Act (HIPAA); whereas health data in other countries may be subject to other regulations and policies and should be handled accordingly. Hence different privacy practices should be maintained for different personal data types in each country.

Despite the foregoing, the present disclosure also contemplates embodiments in which users selectively block the use of, or access to, personal information data. That is, the present disclosure contemplates that hardware and/or software elements can be provided to prevent or block access to such personal information data. For example, in the case of spatial audio rendering, the present technology can be configured to allow users to select to "opt in" or "opt out" of participation in the collection of personal information data during registration for services or anytime thereafter. In addition to providing "opt in" and "opt out" options, the present disclosure contemplates providing notifications relating to the access or use of personal information. For instance, a user may be notified upon downloading an app that their personal information data will be accessed and then reminded again just before personal information data is accessed by the app.

Moreover, it is the intent of the present disclosure that personal information data should be managed and handled in a way to minimize risks of unintentional or unauthorized access or use. Risk can be minimized by limiting the collection of data and deleting data once it is no longer needed. In addition, and when applicable, including in certain health related applications, data de-identification can be used to protect a user's privacy. De-identification may be facilitated, when appropriate, by removing specific identifiers (e.g., date of birth, etc.), controlling the amount or specificity of data stored (e.g., collecting location data a city level rather than at an address level), controlling how data is stored (e.g., aggregating data across users), and/or other methods.

Therefore, although the present disclosure broadly covers use of personal information data to implement one or more various disclosed embodiments, the present disclosure also contemplates that the various embodiments can also be implemented without the need for accessing such personal information data. That is, the various embodiments of the present technology are not rendered inoperable due to the lack of all or a portion of such personal information data. For example, a user-specific interaural HRTF parameter can be estimated based on non-personal information data or a bare minimum amount of personal information, such as the content being requested by the device associated with a user, other non-personal information available to the device processors, or publicly available information.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

In the foregoing specification, the invention has been described with reference to specific exemplary aspects thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A method, comprising:

generating a binaural recording using a plurality of microphones worn by a user;

selecting, using a selection criteria, a plurality of segments of the binaural recording corresponding to sounds emitted at intermittent time points by discrete sound sources located in pseudo-anechoic environments;

measuring an interaural parameter value of each of the selected segments; and estimating, based on the measured interaural parameter values, an interaural head-related transfer function (HRTF) parameter specific to the user.

2. The method of claim 1, wherein the interaural HRTF parameter is selected from the group consisting of a maximum interaural time difference (ITD) and a maximum interaural level difference (ILD).

3. The method of claim 2, wherein the sounds are unknown sounds, wherein the selection criteria includes an interaural coherence threshold, and wherein the selected segments have interaural coherences above the interaural coherence threshold.

4. The method of claim 2, wherein the sounds are known sounds generated by a device, wherein the selection criteria includes a notification indicating emissions of the known sounds by the device at the intermittent time points, and wherein the selected segments occur at the intermittent time points.

5. The method of claim 2, wherein the sounds are unknown sounds, wherein the selection criteria includes a match between the binaural recording and a predetermined sound classification profile, and wherein the selected segments match the predetermined sound classification profile.

6. The method of claim 1 further comprising:

selecting a generic HRTF for the user, wherein the generic HRTF includes one or more generic interaural HRTF parameter; and adapting the generic HRTF based on the interaural HRTF parameter to generate an individualized HRTF of the user.

7. The method of claim 6, wherein adapting the generic HRTF includes adjusting the generic interaural HRTF parameter based on the estimated interaural HRTF parameter to generate the individualized HRTF.

8. The method of claim 6, wherein adapting the generic HRTF includes replacing the generic interaural HRTF parameter with the estimated interaural HRTF parameter to generate the individualized HRTF.

9. The method of claim 1, wherein the interaural HRTF parameter is estimated based on a predetermined minimum number of interaural parameter value measurements.

10. An audio system, comprising:

a plurality of microphones to generate a binaural recording; and one or more processors configured to:

select, using a selection criteria, a plurality of segments of the binaural recording corresponding to sounds emitted at intermittent time points by discrete sound sources located in pseudo-anechoic environments;

measure an interaural parameter value of each of the selected segments; and estimate, based on the measured interaural parameter values, an interaural head-related transfer function (HRTF) parameter specific to a user.

11. The audio system of claim 10, wherein the interaural HRTF parameter is selected from the group consisting of a maximum interaural time difference (ITD) and a maximum interaural level difference (ILD).

12. The audio system of claim 11, wherein the sounds are unknown sounds, wherein the selection criteria includes an interaural coherence threshold, and wherein the selected segments have interaural coherences above the interaural coherence threshold.

13. The audio system of claim 10, wherein the one or more processors are further configured to:

select a generic HRTF for the user, wherein the generic HRTF includes a generic interaural HRTF parameter; and adapt the generic HRTF based on the interaural HRTF parameter to generate an individualized HRTF of the user.

14. The audio system of claim 10 further comprising a headset including the plurality of microphones, and one or more speakers connected to an audio source to play a user content signal.

15. The audio system of claim 14 further comprising a mobile device including the one or more processors and the audio source.

16. A non-transitory machine readable medium storing instructions executable by one or more processors of an audio system to cause the audio system to perform a method comprising:

generating a binaural recording using a plurality of microphones worn by a user;

selecting, using a selection criteria, a plurality of segments of the binaural recording corresponding to sounds emitted at intermittent time points by discrete sound sources located in pseudo-anechoic environments;

measuring an interaural parameter value of each of the selected segments; and estimating, based on the measured interaural parameter values, an interaural head-related transfer function (HRTF) parameter specific to the user.

17. The non-transitory machine readable medium of claim 16, wherein the sounds are unknown sounds, wherein the selection criteria includes an interaural coherence threshold, and wherein the selected segments have interaural coherences above the interaural coherence threshold.

18. The non-transitory machine readable medium of claim 16, wherein the method further comprises:

selecting a generic HRTF for the user, wherein the generic HRTF includes a generic interaural HRTF parameter; and adapting the generic HRTF based on the estimated interaural HRTF parameter to generate an individualized HRTF of the user.

19. The non-transitory machine readable medium of claim 18, wherein adapting the generic HRTF includes adjusting the one or more generic HRTF parameter based on the estimated interaural HRTF parameter to generate the individualized HRTF.

20. The non-transitory machine readable medium of claim 18, wherein adapting the generic HRTF includes replacing the generic interaural HRTF parameter with the estimated interaural HRTF parameter to generate the individualized HRTF.

* * * * *